United States Patent [19]

Jespersen

[11] Patent Number: 4,522,346

[45] Date of Patent: Jun. 11, 1985

[54] METHOD AND APPARATUS FOR DISPENSING WEB MATERIAL FROM SPLIT CORE ROLLS

[75] Inventor: Paul W. Jespersen, Houston, Tex.

[73] Assignee: Georgia-Pacific Corporation, Atlanta, Ga.

[21] Appl. No.: 558,454

[22] Filed: Dec. 6, 1983

[51] Int. Cl.[3] ..... B65H 19/00; B65H 19/04

[52] U.S. Cl. ..... 242/55.3; 242/55.53; 312/39

[58] Field of Search ..... 242/55.3, 55.53, 55.55; 312/38, 39, 40; 221/10, 36, 37, 271, 312 R

[56] References Cited

U.S. PATENT DOCUMENTS

| | | | |
|---|---|---|---|
| 3,039,709 | 6/1962 | Bolger | 242/55.3 |
| 3,211,504 | 10/1965 | Bump | 312/39 |
| 3,387,902 | 6/1968 | Perrin et al. | 312/39 |
| 3,437,388 | 4/1969 | Jespersen | 312/39 |
| 3,438,589 | 4/1969 | Jespersen | 242/55.2 |
| 3,572,600 | 3/1971 | Jespersen | 242/55.3 |
| 3,948,454 | 4/1976 | Bastian | 242/55.3 |
| 4,034,924 | 7/1977 | Carlisle | 242/55.3 |
| 4,340,195 | 7/1982 | De Luca | 242/55.3 |
| 4,383,657 | 5/1983 | Suh | 242/55.3 |
| 4,389,026 | 6/1983 | Willa et al. | 242/55.3 |

FOREIGN PATENT DOCUMENTS

| | | |
|---|---|---|
| 1560720 | 3/1969 | France . |
| 2451737 | 10/1980 | France . |
| 397993 | 2/1966 | Switzerland . |
| 404124 | 6/1966 | Switzerland . |

*Primary Examiner*—Leonard D. Christian

*Attorney, Agent, or Firm*—Banner, Birch, McKie & Beckett

[57] ABSTRACT

A dispenser and dispensing method for flexible web material that is wound into a roll on a transversely split core utilizes a housing having opposed parallel guide tracks to guidingly receive roll core supports projecting from the roll ends and a pivoted control lever providing a lever sensing end to detect the presence of an intact roll core in a roll dispensing position and an upper support end to retain a roll in a reserve roll position. The lever has its sensing end biased toward the intact roll core thereby tending to buckle the split core into sections upon exhaustion of web material from the intact roll core whereupon the core sections with their roll core supports are disengaged from the tracks and the reserve rolls is freed from the lever support end to move to the roll dispensing position.

15 Claims, 5 Drawing Figures

METHOD AND APPARATUS FOR DISPENSING WEB MATERIAL FROM SPLIT CORE ROLLS

BACKGROUND OF THE INVENTION

1. Field Of The Invention

The invention relates to the dispensing of flexible web material such as toilet paper. Specifically, the dispenser and dispensing method of the invention involves the handling of multiple rolls of flexible web material wound on axially aligned core sections defining an intact roll core within each roll of material as long as web material remains wound of these core sections.

The intact core made up of the core sections forms an internal supporting means for the web of flexible web material wound thereon. This internal supporting means extends outwardly beyond the ends of the roll, these outward extensions forming spindles which serve as roll core supports for each roll in handling multiple rolls within the dispenser.

2. Description Of The Prior Art

Jespersen U.S. Pat. No. 3,437,388 exemplifies a prior art dispenser for rolls of toilet paper having internal supporting means forming the roll core within each roll of flexible web material. In this patent the core for each roll is formed by a plurality of axially aligned core sections with each section providing a roll core support spindle projecting from an end of the roll of material.

In the dispenser of the Jespersen U.S. Pat. No. 3,437,388 a plurality of rolls of toilet tissue are accommodated with the roll core supports projecting from opposite ends of each roll being guidingly received in opposed parallel tracks facing inwardly of the dispenser housing. The upper roll physically rests on the lower roll with the lower roll being held in a dispensing position by supporting elements disposed at the lower ends of these opposed tracks.

Jespersen U.S. Pat. No. 3,572,600 may also be noted as disclosing a dispenser for rolls wound on a one piece tubular core.

The dispensing concept of these patents is that the split core defined by the axially aligned sections or one piece core is to drop out of the dispenser when the web of material is substantially exhausted. Thereafter, the upper or reserve roll within the dispenser which has been moving down on its roll core support spindles received in the opposed tracks, while resting on the lower roll, follows the lower roll into the dispensing position.

With the web dispensing system generally described above, there nearly always is some toilet tissue in the form of the web material remaining on the one piece roll core when the core finally falls out of the dispensing position. This not only involves a needless waste of toilet paper, but can contribute to jamming of the dispenser in the event that the core does not fully discharge from the dispenser when the toilet paper is nearly exhausted from the core. This is particularly true in a dispenser for rolls employing structurally rigid internal supporting cores such as disclosed in Jespersen U.S. Pat. No. 3,572,600.

In dispensers such as disclosed in Jespersen U.S. Pat. No. 3,437,388 even though all of the toilet paper is withdrawn from the lower roll in the dispensing position within the dispenser to be totally removed from the transversely split core, it is not always reliably certain that the core sections will drop out automatically. With the reserve roll resting on top of the empty core sections there frequently is too much friction between the top of the empty core sections and the bottom surface of the upper roll. This can prevent the core sections from dropping out automatically. Consequently, it may be required that these empty core sections be manually pulled out from the lower end of the dispenser.

Even when a reserve roll is not present within the dispenser, the empty core sections located in the dispensing position will not always drop out of the dispenser. This can be due to the friction of the core sections where the end caps providing the roll core support spindles remain frictionally engaged against the supporting saddles at the lower ends of the guide tracks within the dispenser.

Therefore, it remains important in the art of dispensing web material from split core rolls, i.e., cores made up of axially aligned core sections which define an intact roll core while web material remains would on such sections, to include means for facilitating and ensuring that the core sections are effectively buckled or separated after the toilet paper had been fully exhausted from being wound on such core sections. This assures the absence of toilet paper wastage or jamming of the dispenser by the core sections not effectively disengaging from the dispenser guide tracks.

SUMMARY OF THE INVENTION

The dispenser and dispensing method of the instant invention overcome the above mentioned problems found to be present in prior art dispensers for toilet paper rolls having cores made up of axially aligned sections. Under this invention, web material dispensing from multiple rolls provided with transversely split cores is achieved. Assurance that the core sections will effectively discharge from the dispenser and then only after all toilet paper has been unwound from the core sections results.

In its broadest aspects, the method invention of dispensing flexible web material from rolls of web material wound on axially aligned core sections which together define an intact core while web material remains wound on these sections, contemplates the capability of handling multiple rolls such that all web material is used or exhausted from the roll in the dispensing position before a reserve roll drops or moves to this dispensing position. Also the method contemplates that the empty core sections which made up the intact roll core will always drop out automatically whether or not a reserve roll is present elsewhere within the dispenser.

Thus, the dispensing method involves retaining separate rolls of material in roll dispensing and reserve roll positions, respectively, while the presence of an intact roll core within the roll retained at the roll dispensing position is sensed. This sensing of the intact roll core is employed to continue retention of a second roll in a reserve roll position, at least retaining the two rolls out of contact with each other as the roll at the dispensing position nears exhaustion of its material. When material is exhausted from the intact roll core the core sections of this roll at the roll dispensing position undergo a buckling action. This action is utilized to effect disengagement of the core sections from the roll dispensing position and also to effect release of the second roll from its retention in the reserve roll position, allowing the second roll to move into the roll dispensing position.

Generally describing the dispenser apparatus, it employs a spring loaded pivoted lever that performs two functions. First, the lever holds the reserve roll away from the roll in dispensing position, at least when the core sections of this latter roll approach becoming empty. Thus, there is no friction between the reserve roll and roll from which toilet paper is being dispensed at the time that this latter roll nears exhaustion of toilet paper. Secondly, the lever applies a slight pressure against the top edge of one of the roll core sections in a direction that tends to lift this roll core off of its support such as to eliminate friction between the roll core section and its support point. This also imparts a force to the end of the roll core section that effectively twists and promotes the buckling action between the core sections to effect their disengagement from retention with the dispenser guide tracks.

Thus, a preferred embodiment of the dispenser of this invention comprises a housing providing opposed parallel track means extending between roll dispensing and reserve roll positions within the housing, these tracks guidingly receiving roll core supports projecting from opposite ends of the rolls from which material is to be dispensed. The first roll is retained in the track means in a roll dispensing position and a lever means pivotally mounted on the housing provides a lower sensing end to sense an intact roll core in this dispensing position and an upper support end to retain a second roll in the reserve roll position. This lever means serves to retain the second roll on the lever support end in the reserve position as long as an intact core is sensed to be present in the dispensing position. This sensing end of the lever tends to buckle the core sections as it presses against the end of the roll core upon exhaustion of web material from the intact roll core so that the core sections disengage from the track means of the dispenser allowing the lever means to shift such that the support end frees the second roll from retention in the reserve position for it to move down into the roll dispensing position.

Having the foregoing description of the invention in mind, it is a principal object of the present invention to provide a dispenser for multiple rolls of flexible sheet material wound on axially aligned core sections wherein a pivotally mounted control lever maintains first and second rolls within the dispenser out of contact with each other with this lever releasing the second or reserve roll for movement into dispensing position when the lever senses exhaustion of web material from the axially aligned core sections making up the intact core for the first roll.

Another object of the invention is to provide an dispenser for multiple rolls of flexible sheet material wound on transversely split cores wherein a control lever applies a buckling force to the core end to promote separation of the sections.

A further object of the invention in a dispenser in accordance with the above object is the inclusion of a biasing force to promote separation of the core sections and directing this force against the core end in a direction that tends to lift the core in conjuntion with the buckling action of the core sections.

Another object of the invention is to provide a web material dispenser for split core rolls wherein the roll retained by its roll core supports projecting from opposite ends of this roll in the roll dispensing position is blocked against removal from this position until all web material is exhausted from the split core thereby obviating pilferage of full or partly used rolls from the dispenser.

The above and other objects of the invention will become apparent from consideration of the following detailed description of a preferred embodiment thereof given in conjunction with the following drawings.

DESCRIPTION OF A PREFERRED EMBODIMENT

Figure 2:
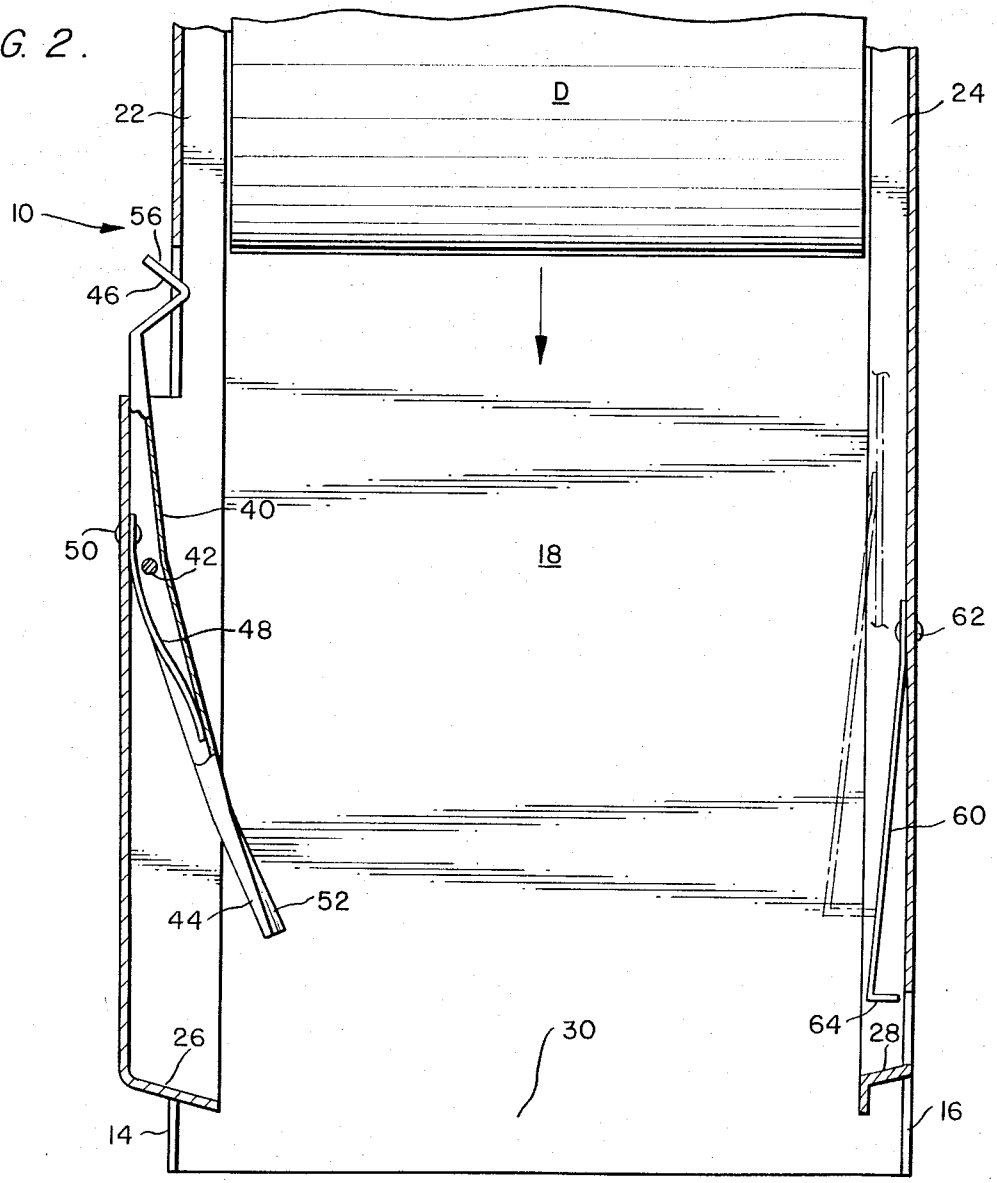
FIG. 2 is a partial sectional view taken through the guide track channels that guidingly receive the roll core supports showing a fragment of a roll moving toward the roll dispensing position at the bottom of these channels.

In describing the dispenser 10 for rolls of flexible web material as shown on the drawings it should be pointed out that to facilitate illustrating structural features of the invention the usual cover that would conventionally be provided has not been shown on the drawings. Reference may be made to Jespersen U.S. Pat. No. 3,437,388 for an exemplification of how a conventional cover completing the dispenser cabinet may be pivotally mounted in relation to the housing forming the chassis for the working components of the dispenser. In the drawings of this application only the dispenser housing 12 forming this chassis has been shown to better illustrate the functional components of the dispenser 10.

Reference has also been made hereinabove to this Jespersen U.S. Pat. No. 3,437,388 as an example of a dispenser for flexible web material which is wound into rolls on axially aligned core sections such that in the roll form these core sections define an intact roll core as along as web material remains wound on such sections. This is the type of roll which the dispenser and dispensing method of the instant invention are intended to accommodate.

With reference to the terminology employed therein, it is to be understood that in referring to rolls of flexible web material wound on axially aligned core sections it is intended that the term core section be construed to include a tubular or cylindrical portion, usually made of paper board, on which the flexible material in the form of toilet paper is conventionally wound together with its end cap which may be molded of plastic and inserted into the tubular portion to provide the roll core support spindle projecting outwardly from the end of the roll.

Figure 3:
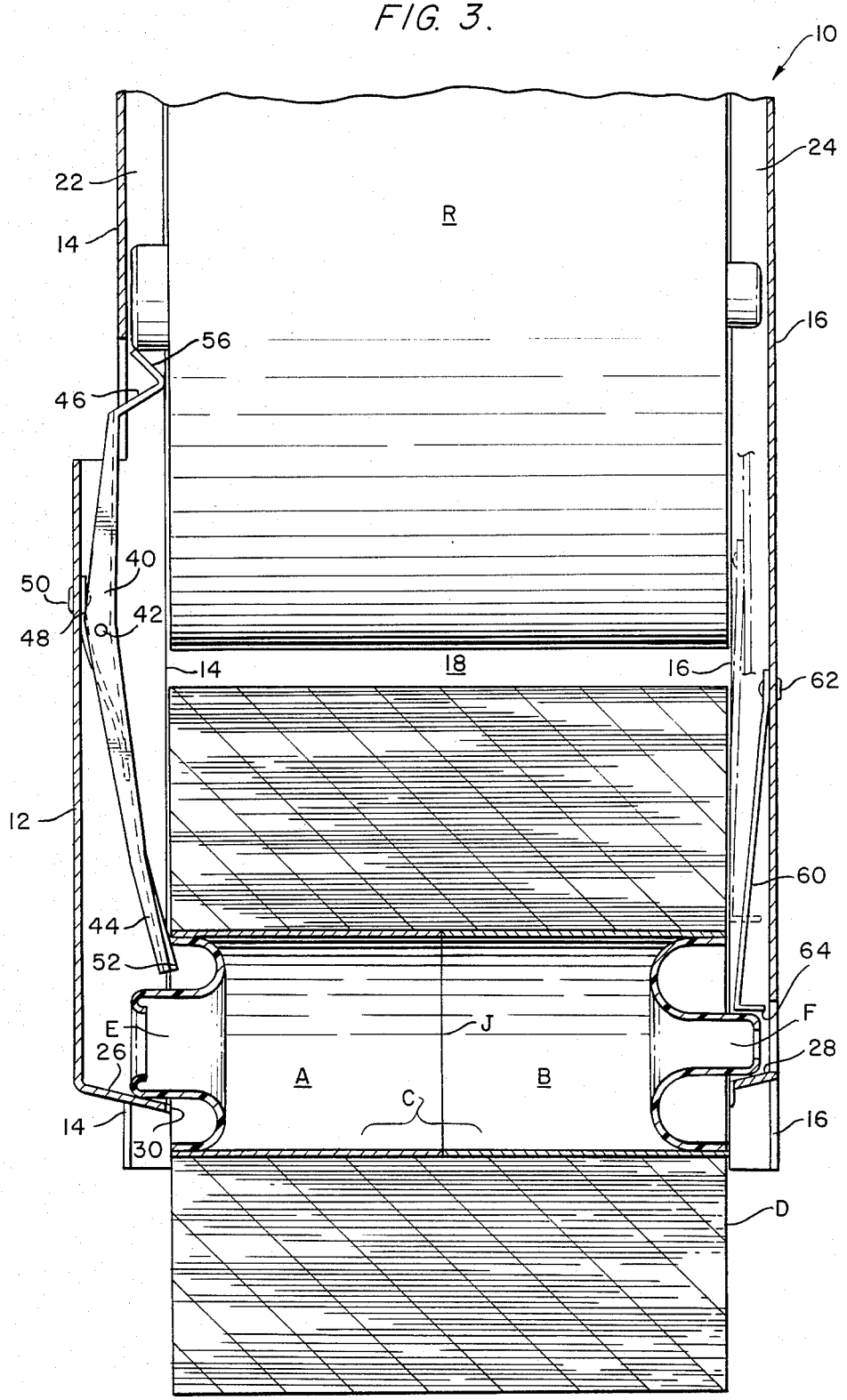
FIG. 3 is a sectional view similar to FIG. 2, but showing a first roll in the roll dispensing position and a second roll retained in the reserve roll position.
Figure 4:
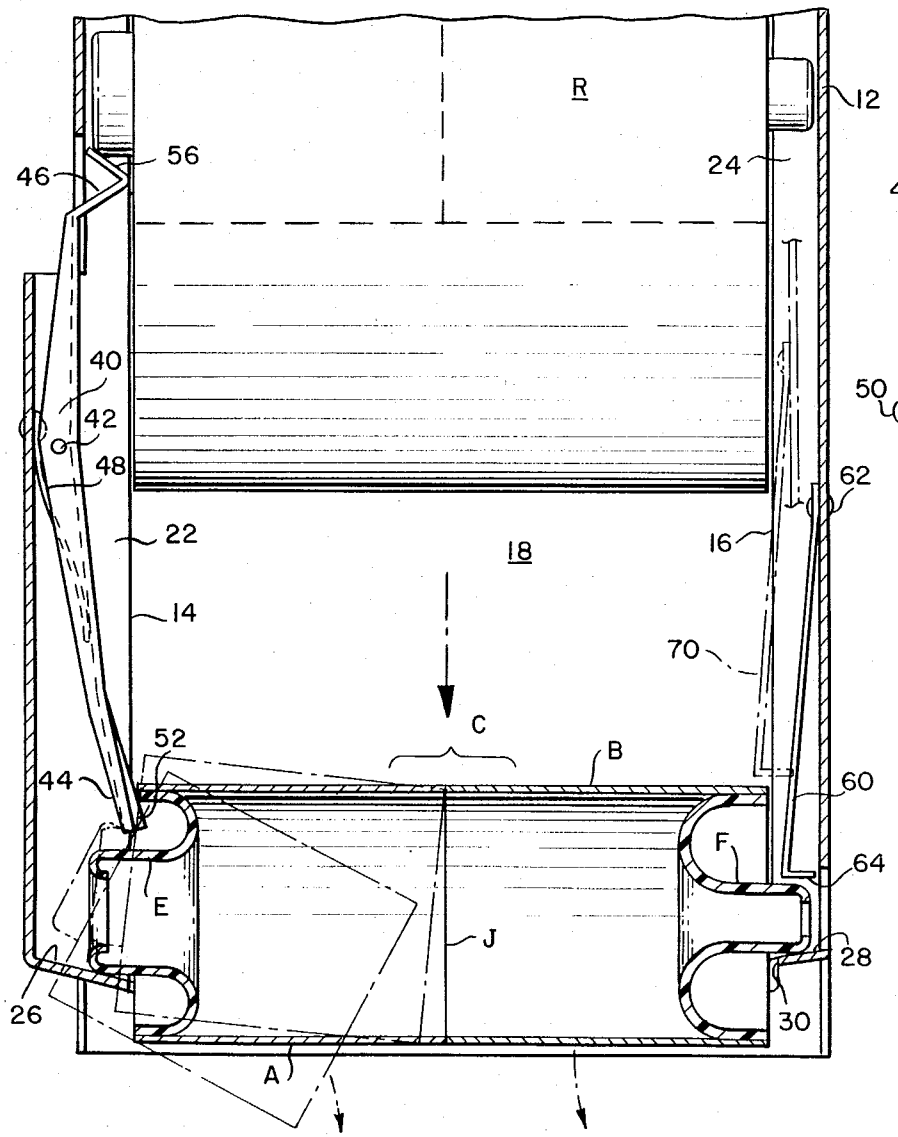
FIG. 4 is a sectional view comparable to FIG. 3, but showing the intact core of the first roll exhausted of web material and in broken lines the buckling action occurring between the core sections.

Two such core sections A and B forming an intact roll core are shown in section on FIGS. 3 and 4.

Likewise, the term core section is to be interpreted as contemplating a core within a roll of web material where the roll core supports projecting from opposite ends of the roll are provided other than by inserted end caps.

Also as used herein it is to be understood that although the aligned core sections making up an intact core while web material remains wound thereon are preferably separate and discrete sections so that they are free to separate or fall apart when the material is totally unwound from the aligned core setions, it is to be understood that the aligned core sections might be retained in the form of an intact roll core by the maintenance of a partial or minor connection between adjoining aligned core sections. For example, the junction or joint between the aligned core sections might be a weakened junction formed such as by perforations or other means which would facilitate the buckling action between the core sections desired to take place in accordance with this invention upon exhaustion of web material from the intact roll core that is made up of these aligned core sections.

Indeed, an end of the toilet paper web may be glued to one of the core sections at the start of winding the roll. Then in using paper from the roll when the end of the roll is reached the act of withdrawing the last bit of paper from the roll will physically pull the core section out of dispenser 10.

Figure 1:
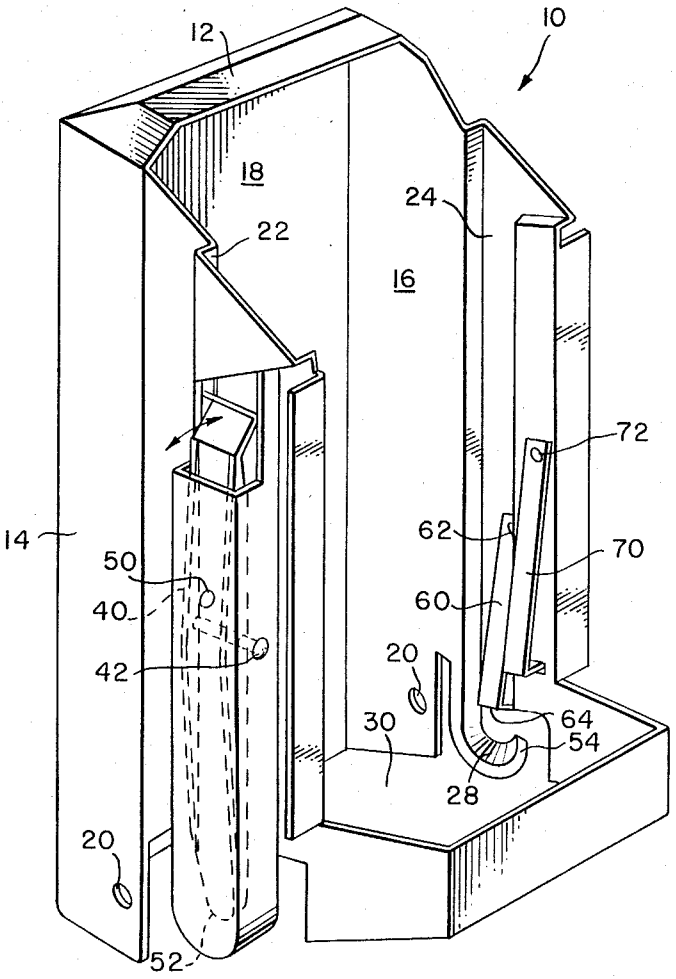
FIG. 1 is a perspective view of the dispenser in accordance with the invention with the conventional cabinet cover removed.

Referring to FIG. 1 on the drawings in describing the dispenser 10, the housing 12 provides a first side wall 14, a second side wall 16 and a back wall 18. It will be understood that in use of dispenser 10 the housing 12 forming the chassis for the working components of the dispenser will be appropriately mounted on a wall at the desired location for dispenser use. Thus, the back 18 of housing 12 will be provided with appropriate openings (not shown) to accommodate the fasteners employed in affixing dispenser 10 to the desired wall location.

As has been mentioned above, the conventional cover which with housing 12 completes the dispenser 10 cabinet is not shown. Side walls 14 and 16 are shown provided with aligned holes 20, these holes serving as pivot points to mount the dispenser cover such as suggested in the dispenser of Jespersen U.S. Pat. No. 3,437,388.

Side wall 14 of housing 12 is provided with an inwardly facing channel 22. Likewise, the second and opposite side wall 16 is provided with an inwardly facing channel 24. As may be best visualized from FIGS. 3 and 4, this pair of inwardly facing channels 22 and 24 serve to guidingly receive the spindles which form part of the roll core sections and serve as the roll core supports where they project from opposite ends of the rolls when the rolls are loaded into the dispenser 10.

Preferably the channels 22 and 24 are of different widths to accommodate different diameter spindles forming the roll core supports for the rolls that are loaded into the dispenser. These different channel widths to mate with different diameter roll core support spindles ensures the proper unwinding direction or orientation in loading the rolls into dispenser 10. However, in the structure of dispenser 10 where the pair of rolls loaded into the dispenser are maintained out of contact with each other in the manner as will be explained, the particular direction of winding or unwinding of the rolls used in the dispenser is not totally critical to dispenser operation.

In any event, the feature of different width guide tracks accommodating different diameter roll core support spindles is known and discussed in the above discussed Jespersen U.S. Pat. No. 3,437,388.

Each of the guide track channels 22 and 24 in the side walls 14 and 16 of housing 12 is provided at its lower end with a saddle member, this member being numbered 26 at the bottom of channel 22 and 28 at the lower end of channel 24. It may be noted that the bottom of housing 12 is open at 30 such that the roll D retained in the roll dispensing position at the bottom of dispenser 10 projects downwardly through open bottom 30 as shown on FIG. 3 for the web material on roll D to be accessible from dispenser 10 to the intending user.

Referring to FIG. 3, the make up of roll D may be described as exemplifying the type of rolls of flexible web material contemplated for dispensing in the dispenser 10 of this invention. Thus, roll D has the flexible web material wound on axially aligned core sections A and B which together define an intact roll core C with a junction J at the separating line between the core sections A and B.

In the form of roll core illustrated, the roll core supports for core C are provided by an end cap E inserted in the outer end of the tubular portion to complete core section A and an end cap F inserted in the tubular portion to complete core section B. It will be seen from FIG. 3 how the core support spindle of end cap E engages in the saddle member 26 at the bottom of channel 22 and the core support spindle of end cap F engages in the saddle member 28 at the bottom of channel 24 to support roll D in the roll dispensing position within the housing 12 of dispenser 10. As so supported, the toilet paper material on roll D projects down through the open bottom 30 of housing 12.

As illustrated on the drawings, the open bottom 30 is defined within the side walls 14 and 16 and back wall 18 of housing 12, these walls extending down beneath saddle members 26 and 28. Generally, with the dispenser cover (not shown) in place, the cover in association with housing 12 might take the configuration shown in the above discussed Jespersen U.S. Pat. No. 3,437,388. With such a configuration the toilet paper material on roll D is exposed through the open bottom 30 of dispenser 10.

It will be understood that the roll R partially shown on FIGS. 3 and 4 as it is retained in the reserve roll position within housing 12 would have a similar make up to that hereinabove described with reference to roll D.

The operating control for the dispenser 10 as between the two rolls D and R loaded into the housing is provided by a control lever 40. This lever is pivotally mounted in channel 22 of side wall 14 on pivot pin 42. This pivotal mounting enables pin 42 to simply pass through the sides of channel 22 to effect the desired mounting of control lever 40.

Lever 40 has a lower sensing end 44 which serves to sense an intact roll core such as that of roll D as shown on FIG. 3 when this first roll is retained at the roll dispensing position within housing 12. An upper support end 46 on pivotally mounted lever 40 serves to retain a second roll in the reserve roll position within housing 12 such as roll R shown on FIG. 3.

A leaf spring 48 which may be riveted at 50 to the outer wall of channel 22 serves to bias control lever 40 toward the position as shown on FIG. 2. This biasing force of spring 48 thus urges the sensing end 44 of lever 40 toward the roll dispensing position within housing 12 and consequently urge support end 46 of lever 40 away from the reserve roll position within housing 12.

It will be noted that the lower sensing end 44 of control lever 40 is contoured and inclined so as to apply a buckling force to the end of the roll core C in a direction tending to lift this intact core, particularly under the biasing force provided by leaf spring 48 acting on lever 40.

Further the terminal portion 52 of the lower sensing end 44 on lever 40 is shaped to be off center from the longitudinal center line of lever 40. This shaping of the terminal portion 52 tends to apply the buckling force that is to operate on the core sections in promoting the buckling action at a point laterally spaced from a vertical plane which includes the rotational axis of the first roll or roll D when it is retained in the roll dispensing position within housing 12 of dispenser 10.

The shaping of the terminal portion 52 disposes the point on such portion 52 that engages with the end of core C of roll D to be in line with the edge of one side of the opposite channel 24, having in mind that channel 24 is of a lesser width than of channel 22 in which lever 40 is pivotally mounted. This edge of track 24 on the opposite side 16 of housing 12 is the edge on the channel 24 side which is closest to the back wall 18 of housing 12, as these parts are shown on FIG. 1.

Locating the point on terminal portion 52 which is to engage the core end opposite the edge of channel 24 that is closest to the back wall 18 insures that core C is held at only two points, these points being directly opposite each other. This two point retention of core C on roll D provides retention of the core in an unstable condition such that when web material is exhausted from the core, the two point support at the opposite core ends promotes the buckling action between the core sections A and B, thereby further insuring their disengagment from the track channels 22 and 24 and the saddle members 26 and 28 of these channels.

To avoid possible three point roll core support and assure the above described two point support between a point on terminal portion 52 of lever 40 and that directly opposite edge of channel 24, the edge of the side of channel 24 that is furthest from the back wall 18 may have a slightly depressed area 54 (FIG. 1). The depressed area 54 is at the point where the core end adjacent channel 24 would otherwise touch this channel side edge located furthest from back wall 18 when the roll core is pushed endwise by the biasing force exerted by lever 40 through its lower sensing end 44. Thus, the depressed area 54 assures that the roll core is held at only two points to establish the above described unstable condition which promotes the buckling action when the web material is exhausted from the aligned roll core sections A and B of roll D.

The upper support end 46 of control lever 40 is formed with a reverse bend in the embodiment shown as to provide a surface 56 which is inwardly inclined relative to the plane of the first side wall 14 of housing 12. This inclined surface 56 physically engages with the roll core support spindle such as shown in FIGS. 3 and 4 with reference to roll R retained in the reserve roll position within housing 12 of dispenser 10.

As will be apparent from the showing on these figures, the inward inclination of surface 56 on the upper support end 46 of lever 40 tends to utilize the weight of roll R acting down through the spindle resting on inclined surface 56 in a manner tending to urge lever 40 and its upper support end 46 outwardly of track 22. Thus, this weight of roll R promotes the lower sensing end 44 of lever 40 to press inwardly against the end of the core C made up of sections A and B thereby tending to buckle the core sections upon exhaustion of web material from the intact roll core of roll D so as to disengage the core sections from the track channels 22 and 24 and their saddle members 26 and 28.

The second side wall 16 of housing 12 is provided with a spring biased latch 60 which may be riveted at 62 to the outer wall of channel 24 for this latch 60 to lie within channel 24. The spring biased latch 60 has its lower end 64 spaced above saddle member 28 at the bottom of channel 24. Thus, it is spaced sufficiently above such saddle member that the spindle of end cap F on core section B may freely rest on saddle member 28 beneath the end of latch 60 as shown on FIGS. 3 and 4.

It will be understood that as the spindle of end cap F moves down along the guide track channel 24 this spindle will act to depress latch 60 until it moves beneath the latch end 64. In this position reverse movement along the guide track 24 is blocked by latch 60. This blocking action serves to prevent the right end of roll D (as shown on FIG. 3) from being raised up within the housing 12 of dispenser 10 thus preventing pilferage of full or partial toilet paper rolls from the dispenser 10.

It will be recognized that the left end of roll D is likewise prevented from being raised back up within channel 22 by the lower sensing end 44 of lever 40 overlying the spindle end cap E forming a part of core section A, again as shown on FIGS. 3 and 4.

The second side wall 16 of housing 12 is also provided with a brake spring 70. This spring may have its upper end suitably riveted at 72 to side wall 16. Spring 70 is positioned adjacent the roll dispensing position within housing 12 to project inwardly and apply frictional resistance to one end of the first roll which is retained in the roll dispensing position. The function of brake spring 70 is to retard rotation of roll D or the roll disposed in the dispensing position so that it does not freely revolve or spin as the web material, such as toilet paper, is withdrawn from dispenser 10 by the intending user.

Operation of the dispener 10 as hereinabove described may now be explained. In FIG. 1 the dispenser housing 12 is shown in its empty or unloaded condition. The sectional view of FIG. 2 shows the intial or first roll D as it is being loaded with its core support spindles (not shown) guidingly engaging with the track channels 22 and 24 as the roll passes down into the dispensing position at the lower end of housing 12.

In FIG. 3 roll D is shown with its support spindles on the core sections A and B resting on the saddle members 26 and 28 of channels 22 and 24, respectively. In this position, roll D has the material thereof exposed through the open bottom 30 of housing 12 for ready access to the intending user. Further in FIG. 3 the second or reserve roll R has been loaded into the housing 12 by its spindles being entered into the upper ends of channels 22 and 24, respectively.

But, the position of roll D as it passed down into the dispensing position location has shifted lever 40 such that the upper support end 46 of such lever has been moved into channel 22 to form a stop within channel 22. As shown on FIG. 3 the left spindle of roll R has come into engagement with this stop by the spindle resting on the inclined surface 56 of upper support end 46 of lever 40.

It will be recognized that the brake spring 70, as best seen on FIG. 1, has been activated by the downward movement of roll D such that spring 70 is applying frictional resistance to retard free rotation of roll D. Likewise, the downward movement of the spindles on roll D into engagement with the saddle members 26 and 28 has caused the spindle on end cap F to pass beneath the latch end 64 on spring biased latch 60. Accordingly, with the lower sensing end 44 of lever 40 overlying the left spindle on roll D and the end 64 of spring biased latch 60 overlying the right spindle of roll D, any attempt to raise the roll D is effectively blocked by these two elements overlying the core support spindles at the opposite ends of roll D.

The above described condition of rolls D and R as shown on FIG. 3 where they are both retained in their respective dispensing and reserve roll positions will continue while utilization of web material from roll D is taking place by the toilet paper web being withdrawn by intending users. Also during this use of web material from roll D the control lever 40, especially under the biasing force of leaf spring 48, will be continuously sensing the intact roll core C made up of the axially aligned core sections A and B. Thus the second roll R in the reserve roll position is continuously retained in this position during the sensing of an intact roll core C.

As will be seen from FIG. 3, the diameter of rolls R and D in relation to the length of lever 40, where such lever extends above its pivot pin 42, is such as to maintain these full rolls R and D out of contact with each other. Thus, with this particular full size roll and length of pivotally mounted lever 40, rolls R and D will be continuously maintained out of contact with each other as web material is being withdrawn from roll D.

However, it is contemplated that the continuing retention of roll R in the reserve roll position, as long as the intact roll core of roll D is sensed, could include a situation where a full reserve roll R initially rests on top of a full roll D when the latter roll is retained in the roll dispensing position. This might occur by reason of different initial full roll diameters and/or a different length of pivoted lever 40. In such a situation, the continuing retention of roll R in the reserve roll position while resting on roll D will, in effect, be caused by the roll R itself sensing that roll D has an intact roll core. This sensing would occur even though the left spindle of roll R has not yet come into engagement with the stop formed by the upper support end 46 of lever 40 disposed within channel 22.

Then as material is withdrawn from roll D with consequent reduction in the diameter of roll D, roll R will move down with its spindles in guide track channels 22 and 24 until the spindle in channel 22 comes into engagement with and thereafter rests upon the upper support end 46 of lever 40. Thereafter, withdrawal of material from roll D, causing continued reduction in the diameter of roll D, leaves roll R continuing to be retained in the reserve roll position, but now sensing of the intact core of roll D is done by pivoted lever 40.

Thus, the sensing of the intact core C of roll D is employed to continue retention of roll R in the reserve roll position with the two rolls out of contact with each other at least when the core sections of roll D approach becoming empty so that in this latter stage of exhausting roll D there is no friction between the reserve roll R and roll D. The important concept is that sensing of the intact core of roll D be utilized to continue retention of roll R in the reserve roll position and at least retain the two rolls out of contact with each other during the stage when roll D nears exhaustion of its web material.

When the web material is fully withdrawn and roll D becomes exhausted the condition shown on FIG. 4 exists. At this time the reserve roll or second roll R is still retained in the reserve roll position at the upper end of housing 12. However, the lower sensing end 44 of lever 40 as it presses against the end of the intact roll core C urges buckling of the core sections A and B upon the occurrence of exhaustion of web material from the intact core C. This effects disengagement of the core sections A and B from retention in the roll dispensing position. More specifically, it urges the core sections A and B to progress through the broken line showing for one core section A at the left on FIG. 4. Thus, the force applied by the sensing end 44 not only applies a buckling force to the core end, but by reason of the contour and shaping of sensing end 44 at 52 it directs this buckling force against the core end in a direction tending to lift the core off of the saddle member 26, thereby freeing it from the friction which previously existed between the roll core support spindle and saddle member 26 during normal use of web material from roll D.

As the intact core C undergoes the buckling action between its core sections A and B following exhaustion of web material from the intact roll core, the core sections disengage from the track channels 22 and 24 and their saddle members 26 and 28, falling out of the open bottom 30 of housing 12. This frees lever 40, especially under the urging of leaf spring 48, to move to a position as is shown in FIG. 2.

This movement effectively shifts the sensing end 44 of lever 40 into the roll dispensing position area and likewise shifts the support end 46 of lever 40 away from the reserve roll position area thereby opening track guide channel 22 such that the spindles of roll R are now freed for this roll to move down into the dispensing position at the bottom of housing 12.

Figure 5:
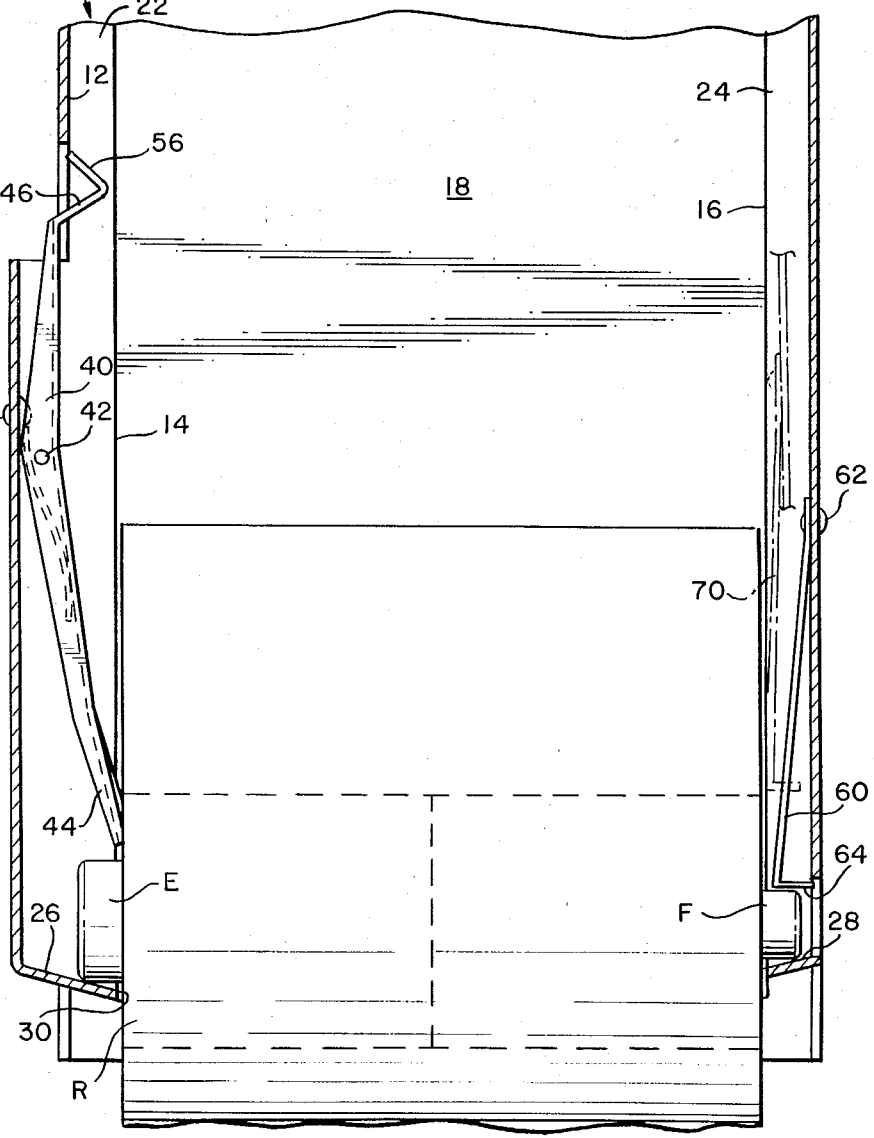
FIG. 5 is a sectional view similar to FIG. 4 showing the second roll having moved from the reserve position in FIG. 4 into the roll dispensing position.

This condition for roll R is shown on FIG. 5. From this figure it will be noted that the lever 40 has again been shifted by its lower sensing end 44 detecting the intact core within roll R. This shifting of lever 40 again moves the upper support end 46 of lever 40 into a position to block track channel 22. Thereafter, in loading a new roll into the dispensing housing 12, by entering its outwardly projecting roll core support spindles into the opposite channels 22 and 24, this new roll can only pass down these channels to a point where one of its spindles encounters the upper support end 46 of lever 40 which is blocking the channel 22. Again this new roll will be held in reserve until such time as the roll located in the roll dispensing position resting on the saddle members 26 and 28 has been exhausted. Upon exhaustion of material from this latter roll, the process of the buckling action acting on the core sections to discharge them from the track channels and saddle members will repeat itself whereafter the new roll retained in the reserve position will be released.

While the foregoing is believed to constitute a complete description of a preferred embodiment of the invention, it is to be recognized that various modifications, changes, alterations, etc. may well appear to those skilled in the art. Therefore, the invention is not considered to be limited by the specifics of the disclosed embodiment, but rather to be embrasive of all subject matter falling within the terms of the hereinafter appended claims or their equivalents.

I claim:

1. A method of dispensing flexible web material from rolls that are wound on axially aligned core sections which define an intact core within each roll of material while web material remains wound on such sections comprising the steps:

retaining first and second rolls of material in roll dispensing and reserve roll positions, respectively;

sensing the intact roll core of said first roll being retained at said roll dispensing position;

continuing retention of said second roll in said reserve roll position during sensing of said intact roll core; and utilizing the buckling action of the core sections making up said intact core which occurs upon exhaustion of web material from said intact core to effect disengagement of said core sections from retention in said roll dispensing position and release of said second roll from retention in said reserve roll position for said second roll to move to said roll dispensing position.

2. A method of dispensing flexible web material as recited in claim 1 further comprising the step of supporting said second roll for guided movement from said reserve roll position to said roll dispensing position.

3. A method of dispensing flexible web material as recited in claim 1 further comprising the step of securing the end of said flexible web material to one of said core sections at the start of winding a roll.

4. A method of dispensing flexible web material as recited in claim 1 wherein said retaining includes continuously maintaining said first and second rolls of material out of contact with each other during said continuing retention.

5. A method of dispensing flexible web material as recited in any one of claims 1, 2, 3, or 4 wherein said sensing of an intact roll core includes applying a buckling force to the core end to promote separation of said core sections.

6. A method of dispensing flexible web material as recited in claim 5 wherein said applying a buckling force to said core end includes directing said force against said core end in a direction tending to lift the intact core in conjunction with said buckling action.

7. A dispenser for rolls of flexible web material wound on axially aligned core sections defining an intact roll core while web material remains wound on such sections comprising:

a housing providing opposed parallel track means extending between roll dispensing and reserve roll positions within said housing to guidingly receive roll core supports projecting from opposite ends of the rolls;

abutment means associated with said track means to retain a first roll in said roll dispensing position; and lever means pivotally mounted on said housing having a lower sensing end to sense an intact roll core in said dispensing position and an upper support end to retain a second roll in said reserve roll position, said support end of said lever means retaining said second roll in said reserve position during sensing of an intact core in said dispensing position and said sensing end tending to buckle the core sections upon exhaustion of web material from the intact roll core to disengage the core sections from said track means whereupon said lever means shifts said support end to free said second roll from retention in said reserve roll position to move to said roll dispensing position.

8. A dispenser as recited in claim 7 wherein said track means is provided by an inwardly facing channel on each side wall of said housing and said abutment means is provided by a saddle member adjacent the lower end of each said channel, said channels serving to guidingly receive spindles forming part of the roll core sections that provide said roll core supports, said spindles engaging in said saddle member to retain said first roll in said roll dispensing position.

9. A dispenser as recited in claim 7 further having means biasing said lever means to urge said sensing end toward said roll dispensing position and said support end away from said reserve roll position.

10. A dispenser as recited in one of claims 7 or 9 wherein said lever means includes a lever pivoted intermediate said sensing and support ends on a first side wall of said housing.

11. A dispenser as recited in claim 10 wherein said track means is provided by an inwardly facing channel on each side wall of said housing, said abutment means is provided by a saddle member adjacent the lower end of each said channel, and said lever is pivotally mounted within one of said channels.

12. A dispenser as recited in claim 10 including a spring biased latch mounted on a second side wall of said housing to block reverse movement along said track means of the roll core support at one end of said first roll.

13. A dispenser as recited in claim 12 including a brake spring mounted on one of the side walls of said housing positioned adjacent said roll dispensing position to project inwardly and apply frictional resistance to the end of said first roll retained in said roll dispensing position.

14. A dispenser as recited in claim 10 wherein said sensing end of said lever is contoured to applying a buckling force to a roll core end in a direction tending to lift the intact core in conjunction with said buckling of the core sections, and said support end of said lever is formed with a surface inwardly inclined relative to said first side wall to engage with a roll core support at one end of said second roll to retain said second roll in said reserve roll position.

15. A dispenser as recited in claim 14 wherein said sensing end of said lever has a terminal portion off center from the lever's longitudinal centerline to apply said buckling force at a point laterally spaced from a vertical plane that includes the rotational axis of said first roll retained in said roll dispensing position.

* * * * *